US012729493B2

(12) United States Patent
Hedrington

(10) Patent No.: US 12,729,493 B2
(45) Date of Patent: Sep. 8, 2026

(54) MONITOR MACHINE CONDITIONS TO IDENTIFY STICKING OR BURNING MATERIAL

(71) Applicant: Caterpillar Paving Products Inc., Brooklyn Park, MN (US)

(72) Inventor: Mathew J. Hedrington, Ham Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 804 days.

(21) Appl. No.: 18/112,236

(22) Filed: Feb. 21, 2023

(65) Prior Publication Data

US 2024/0279885 A1 Aug. 22, 2024

(51) Int. Cl.
*E01C 23/01* (2006.01)
*E01C 19/48* (2006.01)

(52) U.S. Cl.
CPC ..... *E01C 23/01* (2013.01); *E01C 19/4853* (2013.01); *E01C 2301/10* (2013.01)

(58) Field of Classification Search
CPC ... E01C 19/4853; E01C 23/01; E01C 2301/10
USPC ..... 404/77, 79, 84.05–84.5, 95, 118
See application file for complete search history.

(56) References Cited

U.S. PATENT DOCUMENTS

| | | | | |
|---|---|---|---|---|
| 5,356,238 | A * | 10/1994 | Musil | E01C 19/008 404/101 |
| 5,895,172 | A | 4/1999 | Grembowicz et al. | |
| 8,297,875 | B1 * | 10/2012 | Kopacz | E01C 19/48 404/118 |
| 8,636,442 | B1 | 1/2014 | Sopko, Jr. et al. | |
| 9,476,168 | B2 | 10/2016 | Oetken et al. | |
| 10,280,572 | B1 * | 5/2019 | Thiesse | H05B 1/023 |
| 10,316,476 | B2 | 6/2019 | Marsolek et al. | |
| 10,550,528 | B2 | 2/2020 | Thiesse | |
| 10,760,228 | B2 | 9/2020 | Heindtel et al. | |
| 2006/0045620 | A1 * | 3/2006 | Olson | E01C 19/48 404/101 |
| 2009/0317186 | A1 * | 12/2009 | Glee | E01C 23/01 404/75 |
| 2010/0232877 | A1 * | 9/2010 | Sanvik | E04G 21/06 700/275 |
| 2013/0322964 | A1 * | 12/2013 | Buschmann | E01C 19/48 404/75 |
| 2022/0064874 | A1 * | 3/2022 | Buschmann | E01C 19/48 |

FOREIGN PATENT DOCUMENTS

| | | | | |
|---|---|---|---|---|
| EP | 3896223 B1 * | 12/2024 | | E01C 19/288 |

* cited by examiner

*Primary Examiner* — Raymond W Addie

(57) ABSTRACT

A paving machine can include a frame including a hopper; a screed coupled to the frame and including a screed plate; a first temperature sensor configured to measure a first temperature of a paving material in the hopper; a second temperature sensor to measure a second temperature of the screed plate; and a controller to receive the first and second temperatures and configured to determine an operating condition of the screed plate based on the first and second temperatures.

15 Claims, 3 Drawing Sheets

MONITOR MACHINE CONDITIONS TO IDENTIFY STICKING OR BURNING MATERIAL

TECHNICAL FIELD

The present disclosure generally relates to paving equipment. More particularly, the present disclosure relates to an asphalt paving machine.

BACKGROUND

Paving machines are used to apply, spread, and compact paving material relatively evenly over a desired surface. These machines are regularly used in the construction of roads, parking lots and other areas where a smooth durable surface is required for cars, trucks, and other vehicles to travel. An asphalt paving machine generally includes a hopper for receiving asphalt material from a truck and a conveyor system for transferring the asphalt rearwardly from the hopper for discharge onto a roadbed. Screw augers may be used to spread the asphalt transversely across the roadbed in front of a screed. A screed plate on the screed smooths and somewhat compacts the asphalt material and ideally leaves a mat of uniform depth and smoothness.

However, paving material sticking to the screed plate while paving can reduce mat quality. Therefore, heating systems on the screed plate are used to prevent sticking. However, if the screed plate is too hot it can burn the material, and if it is too cold material can build up on the screed plate and reduce the quality of the mat.

U.S. Pat. No. 8,636,442 discusses a paving machine using an integrated generator to warm a screed and sensing devices to measure a temperature of the screed.

SUMMARY

In an example according to this disclosure, a paving machine can include a frame including a hopper, a screed coupled to the frame and including a screed plate, a first temperature sensor configured to measure a first temperature of a paving material in the hopper; a second temperature sensor to measure a second temperature of the screed plate; and a controller to receive the first and second temperatures and configured to determine an operating condition of the screed plate based on the first and second temperatures.

In one example, a paving machine can include a frame; a screed coupled to the frame and including a screed plate; a mat quality sensor configured to determine a quality of a mat behind the screed; and a controller configured to receive the mat quality information from the mat quality sensor and configured to determine an operating condition of the screed plate based on the mat quality information.

In one example, a method of monitoring a condition of a screed plate of a paving machine can include measuring a first temperature of a paving material in a hopper of the paving machine; measuring a second temperature of the screed plate; and a controller determining, from the first and second temperatures, an operating condition of the screed plate based on the first and second temperatures.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
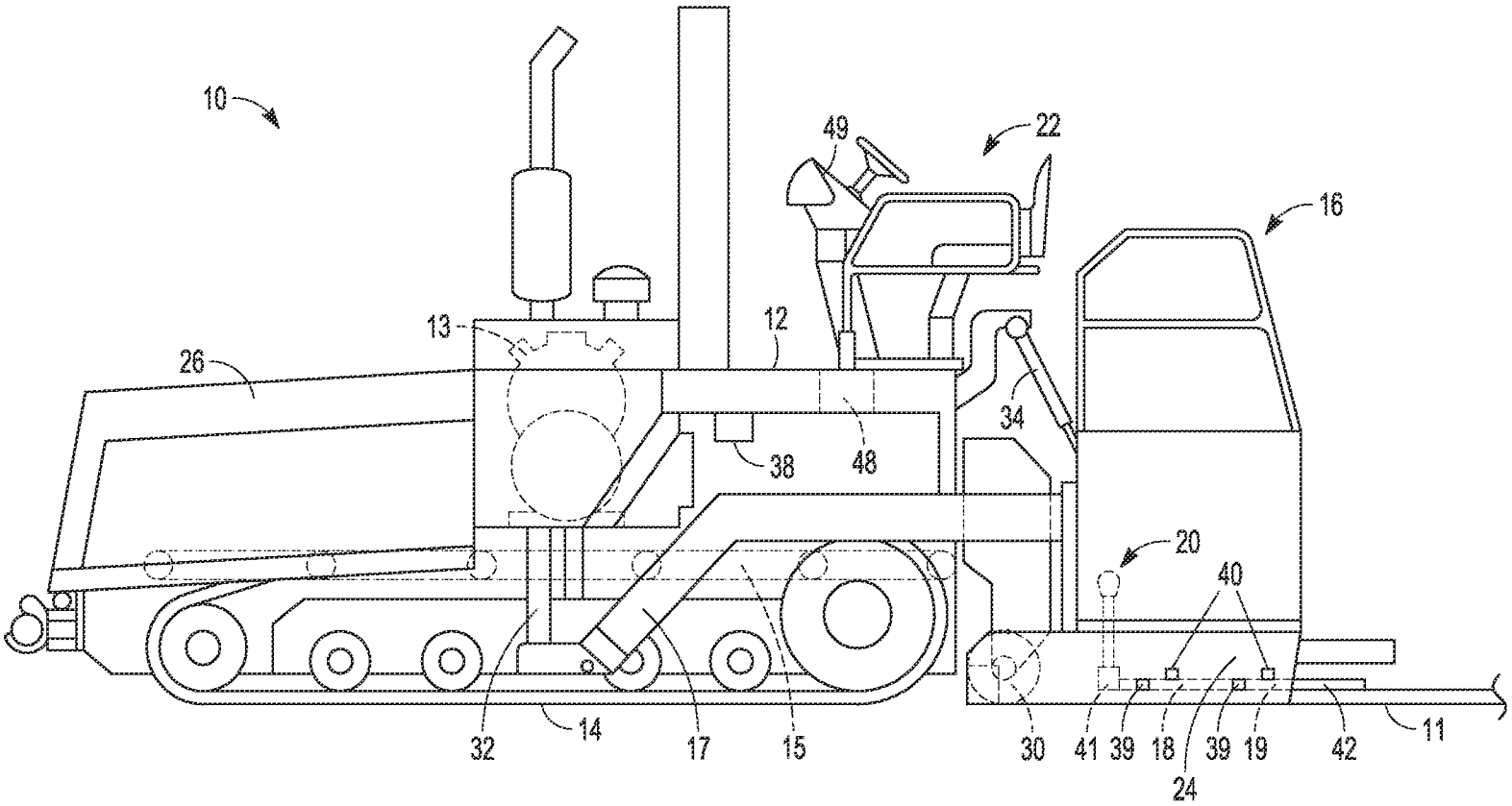
FIG. 1 shows a side view of a paving machine, in accordance with one embodiment.

FIG. 1 shows a side view of a paving machine 10 in accordance with one embodiment. The paving machine 10 generally includes a frame 12 with a set of ground-engaging elements 14 such as tracks or wheels coupled with the frame 12 (the term "coupled" is used broadly and encompasses both a direct connection between two components and an indirect connection between two components such that the two components are connected by one or more intermediate components). The ground-engaging elements 14 may be driven by an engine 13 in a conventional manner. A screed 16 can be positioned at the rear end of the paving machine 10 to spread and compact paving material into an asphalt mat 11 having a desired thickness, size, uniformity, crown profile and cross slope. The paving machine 10 also includes an operator station 22 having a seat and a console, which includes various controls for directing operations of the paving machine 10 by inputting instructions at an input panel 49. It is also contemplated that the paving machine 10 could be operated by an operator located remotely, or even be operated autonomously. A controller 48 is provided for electrically controlling various aspects of the paving machine 10. For example, the controller 48 can send and receive signals from various components of the paving machine during the operation of the paving machine 10.

The paving machine 10 further includes a hopper 26 for storing a paving material, and a conveyor system including one or more conveyors 15 configured to move paving material from the hopper 26 to the screed 16 at the rear of the paving machine 10. One or more augers 30 are arranged near the forward end of the screed 16 to receive the paving material supplied by the conveyor 15 and spread the material evenly beneath the screed 16.

Reference to the "forward" end of the screed 16 means the end of screed 16 facing in the direction of travel of paving machine 10 as paving machine 10 is applying the paving material to a surface (to the left in FIG. 1). Similarly, reference to a "forward-facing" surface of a component of screed 16 means a surface facing in the direction of travel of paving machine 10 while paving machine 10 is applying paving material to a surface, while reference to an "aft-facing" surface of a component means a surface facing away from the direction of travel of paving machine 10 while paving machine 10 is applying paving material to a surface (to the right in FIG. 1).

The screed 16 can be pivotally coupled behind the paving machine 10 by a pair of tow arms 17 that extend between tow points on the frame 12 of the paving machine 10 and the screed 16. The tow arms 17 can be pivotally connected to the frame 12 such that the relative position and orientation of the screed 16 relative the surface being paved may be adjusted by pivoting the tow arms 17, for example, in order to control the thickness and grade of the paving material deposited by the paving machine 10.

Each tow arm 17 can also have the tow point raised and lowered on the machine 10 using a positioning cylinder 32 which when moved up and down moves the tow point of the tow arms 17 and changes an angle of attack of the screed 16. The tow arms 17 can be moved together or independently. Also, as part of the paving process, one or more cylinders 34 on the screed 16 can raise or lower portions of the screed 16. For example, to change a height or paving angle of a main screed plate 18 and one or more extender screed plates 19.

The screed 16 can include a screed frame 24 with the main screed plate 18 coupled to the screed frame 24. The screed plate 18 is configured to float on the paving material of the asphalt mat 11 laid upon a prepared paving bed and to "smooth" or level and compact the paving material on the base surface, such as for example a roadway or roadbed. The screed 16 can further include the one or more extender screed plates 19 that extend outwardly beyond the main screed plate 18 to extend the paving width of the screed 16. In the present discussion, the screed plate 18 will be primarily discussed. However, it is understood that any reference to screed plate 18 can also refer to the extender screed plate 19.

The screed plate 18 can include a plurality of heating elements 39 that can be controlled by the controller 48 to heat up the screed plates 18 to a desired temperature. As noted above, heating systems on the screed plate 18 are used to prevent sticking.

The screed 16 can further include a tamper bar assembly 20 positioned forward of the screed plate 18 and extending transversely to the direction of travel of the paving machine 10. The tamper bar assembly 20 may include a tamper bar 41. Tamper bar assembly 20 can be coupled to the screed frame 24 of screed 16 and configured such that the tamper bar 41 is reciprocated in an upward and downward direction substantially perpendicular to the asphalt mat 11 and substantially perpendicular to the direction of travel of paving machine 10. The tamper bar assembly 20 pre-compacts the paving material as the paving machine 10 moves forward and the screed 16 smooths the paving material to remove air pockets and other voids to create a flat, paved surface.

As discussed above, material sticking to the screed plate 18 while paving can reduce mat quality. Therefore, while paving asphalt, the heating elements 39 can be used to heat up the screed plate 18 to prevent sticking. However, the desired temperature of the screed plate 18 should be adjusted according to the material being paved. If the screed plate 18 is too hot such that it burns the material, or too cold such that it allows sticking, material can build up on the screed plate 18 and reduce the quality of the mat 11. (It is noted that the tamper bar assembly 20 can also include a heating element to heat up the tamper bar and that the following discussion of the screed plate 18 should be understood to also apply to the tamper bar).

Accordingly, the present system provides techniques for identifying problem situations that can arise, such as initiating paving before the screed plate 18 is heated sufficiently or paving when the screed plate temperature is significantly higher/lower than the delivered paving material.

By monitoring machine conditions before/during/after paving operations, buildup of excess material on the screed plate 18 can be identified and an operator can be informed/instructed to inspect and clean the machine as necessary to restore performance. The operator could be located on the machine or remotely. As will be discussed, these machine conditions can be determined using temperature sensors to determine the paving material temperature as delivered, and screed plate temperature sensors to measure the temperature of the screed plate 18. In some embodiments, information from mat quality sensors (visual, tactile) can be used as inputs to analyze the effectiveness of the screed plate 18. When decreased performance is identified, the operator and other monitoring systems can be notified and maintenance/cleaning can be planned.

Accordingly, the paving machine 10 can include a first temperature sensor 38 configured to measure a first temperature of a paving material in the hopper 26. For example, the sensor 38 can include an optical temperature sensor such as an infrared (IR) sensor to determine the temperature of the material within the hopper 26. The system can include a second temperature sensor 40 to measure a second temperature of the screed plate 18. In one example, a plurality of second temperature sensors 40 can be used to measure the temperature of the screed plate 18 across the width and length of the screed plate 18 to determine an average screed plate temperature.

Figure 2:
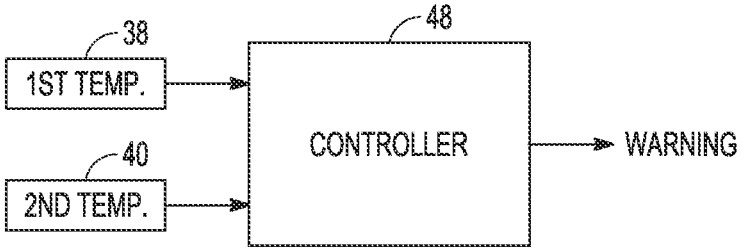
FIG. 2 shows a control system for a paving machine, in accordance with one embodiment.

Referring now also to FIG. 2, which shows a control system for the paving machine 10, in accordance with one embodiment, the controller 48 can receive the first and second temperatures from the first and second temperature sensors 38, 40 and be configured to determine an operating condition of the screed plate 18 based on the first and second temperatures.

For example, the operating condition of the screed plate can be that the screed plate 18 may burn the paving material or that the paving material may stick to the screed plate 18. In determining the operating condition of the screed plate 18, the controller 48 can predict, based on a database of past performance, how the paving material at a given first temperature will react when being passed over by a screed plate of a given second temperature. The controller 48 can therefore predict that the screed plate 18 is too hot or too cold depending on the measured temperatures. The controller 48 compares the first and second temperature and can determine if the temperature difference is in a pre-determined proper range. If the difference is too high, the controller determines that a problem with buildup of material may occur from sticking or burning on.

In this embodiment, the controller 48 can be configured to deliver a warning to an operator of the paving machine 10 if the controller 48 determines that the operating condition of the screed plate 18 is not correct. For example, the controller 48 can determine that the temperature difference between the delivered material and the screed plate 18 is not within an allowable range. If the difference in temperatures is out of the desired range, the controller can determine that the screed plate 18 is not in the proper operating condition and material will build up on the screed plate 18. For example, the controller 48 can activate a warning light or other warning signal or can otherwise inform the operator that the screed plate 18 needs to be heated up or cooled down so as to be in the right temperature range to properly receive the paving material at the paving material given temperature.

Figure 3:
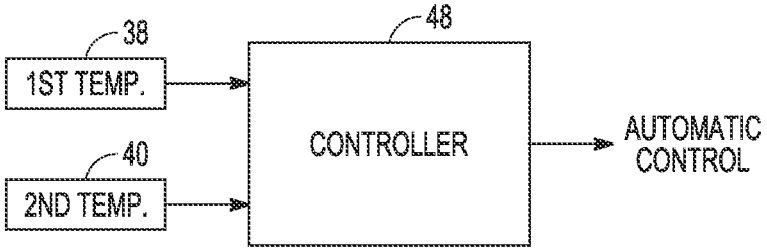
FIG. 3 shows a control system for a paving machine, in accordance with one embodiment.

FIG. 3 shows a control system for the paving machine 10, in accordance with one embodiment. In this example, the controller 48 can be configured to automatically change the second temperature of the screed plate 18 if the controller 48 determines that the operating condition of the screed plate 18 will result in paving material building up on the screed plate 18 because the screed plate is too cold (sticking) or too hot (burning on) For example, the controller 48 can determine that the temperature difference between the delivered material and the screed plate 18 is not within an allowable range. If the difference in temperatures is out of the desired range, the controller 48 can determine that the screed plate 18 is not in the proper operating condition and can change the temperature of the screed plate 18.

In some examples, the controllers 48 of FIGS. 2 and 3 can be combined and either control technique (manual or automatic) or a combination of the two can be used depending on machine settings or operator wishes.

Referring again to FIG. 1, in one embodiment, the paving machine 10 can include a mat quality sensor configured to determine a quality of the mat 11 behind the screed plate 18. In some examples, the mat quality sensor can include a visual sensor 36 and/or a tactile sensor 42. The mat quality sensor can feed mat quality information to the controller 48 and the controller can be configured to perform an objective determination of mat quality based on any bumps or flaws in the mat, such as a drag mark in the mat.

Figure 4:
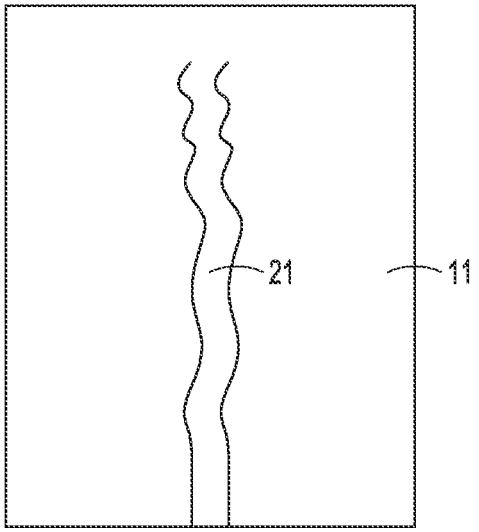
FIG. 4 shows a top view of a mat, in accordance with one embodiment.

For example, FIG. 4 shows a top view of the mat 11, with a drag mark 21 in the mat 11 behind the screed. The drag mark 21 can be formed by material building up on the screed plate 18. The mat quality sensor(s) 36, 42 can be configured to send the mat quality information to the controller 48 to determine a degree of the flaw.

In one embodiment, the visual sensor 36 can include a smart camera or a lidar sensor capable of scanning the asphalt mat surface behind the screed 16 and transferring the information to the controller to enable the controller 48 to create a virtual 3D image of the surface.

In one embodiment, the tactile sensor 42 can be dragged over the mat 11 behind the screed 16. For example, the tactile sensor 42 can be a mechanism including a plurality of sensors forming a bed-of-nails pattern that can physically pass over the mat 11 to determine if any flaws are present in the mat 11. Again, the controller 48 can receive the information from the visual sensor 36 or the tactile sensor 42 and determine if any flaws are present. For example, the tactile sensor 42 can pass over the mat 11 and a detected pressure on, or displacement of, different nails of the bed-of-nails can be used by the controller 48 to determine a 3-D representation of the mat 11 and therefore can determine if there are any physical flaws in the mat 11.

Figure 5:
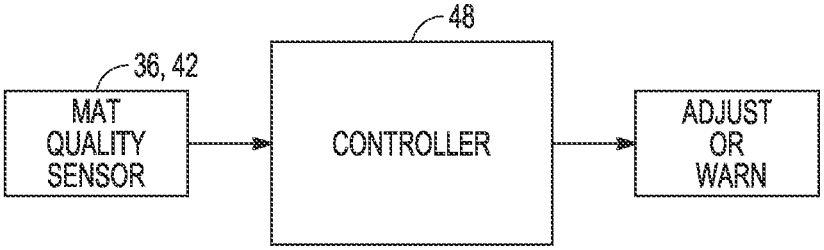
FIG. 5 shows a control system for a paving machine, in accordance with one embodiment.

FIG. 5 shows a control system for a paving machine, in accordance with one embodiment. In this example, the controller 48 receives mat quality information from one or more of the mat quality sensors 36, 42 and the controller 48 can be configured to determine an operating condition of the screed plate 18 based on the mat quality information.

In one embodiment, the controller 48 can be configured to automatically change the second temperature of the screed plate 18 if the controller 48 determines that the operating condition of the screed plate 18 has resulted in material sticking to the screed plate 18. Thus, the controller 48 can be configured to automatically change a temperature of the screed plate 18 if the controller 48 determines that the operating condition of the screed plate 48 is causing the physical flaws. For example, the screed plate 18 temperature can be raised or lowered.

In one embodiment, the controller 48 can be configured to deliver an operator warning to raise the temperature of the screed plate 18 if the controller determines the screed plate 18 is too cold and material is sticking to the screed plate 18, or to reduce the temperature of the screed plate and clean the screed plate 18 if the controller determines that the screed plate is too hot and the paving material is burned or is likely to be burned onto the screed plate 18.

Figure 6:
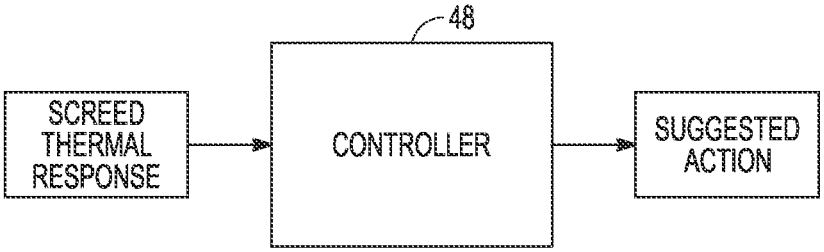
FIG. 6 shows a control system for a paving machine, in accordance with one embodiment.

FIG. 6 shows a control system for a paving machine, in accordance with one embodiment. The system of FIG. 6 represents another technique to identify a potential problem with the screed plate 18. In this example, the controller 48 can be configured to compare the expected thermal response of the screed plate 18 when being heated up to the actual behavior of the screed plate 18 and use the information to identify material build-up.

For example, in one embodiment, the controller 48 can include a database of expected screed plate thermal responses to a given screed plate temperature setting and the controller 48 can be configured to determine if the screed plate 18 is taking too long to heat up. For example, if the screed plate 18 should reach a certain operating temperature within 10 minutes, and it takes 20 minutes to reach the temperature, the controller 48 can determine that there is paving material stuck to the screed plate 18 and can warn the operator to clean the screed plate 18.

These examples described above can be used separately to monitor the operating condition of the screed plate or can be combined in any manner. Moreover, machine learning can be used by the controller 48 so the controller 48 can improve at predicting how certain changes will affect the screed. The factors of temperatures of paving material, temperature of the screed, mat quality, and screed thermal response to heat up can all be continually analyzed by the controller 48 to enable continual machine learning to determine optimal settings. In various examples, the controller 48 can be any suitable device such as a microcontroller and can include one or more of a microprocessor, memory, databus, I/O devices, and network communication interfaces, etc. In some examples, the controller 48 can be located remote from the work machine such that the machine operation is controlled in whole or in part remotely.

INDUSTRIAL APPLICABILITY

The present system is applicable to paving systems. The operating condition of the screed performance at various stages and times during the paving process can be improved. Accordingly, a process for improved screed monitoring has been devised.

Figure 7:
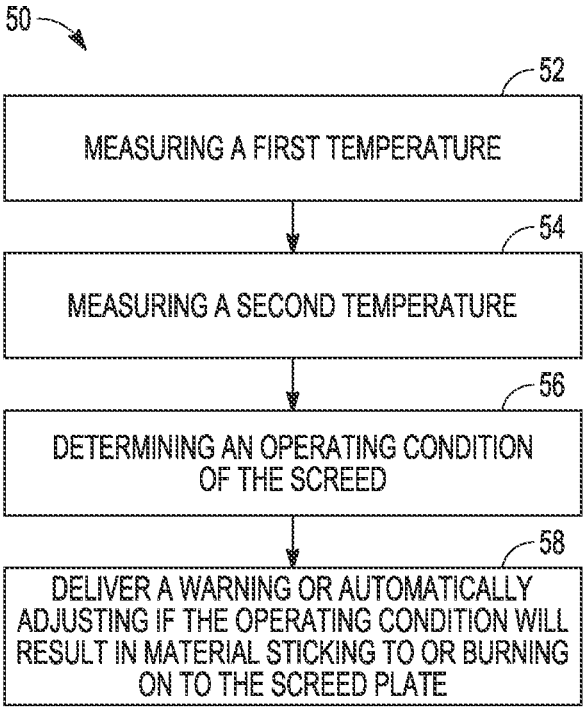
FIG. 7 shows a method of monitoring a condition of a screed plate of a paving machine, in accordance with one embodiment.

FIG. 7 shows a method of monitoring a condition of a screed plate of a paving machine (50), in accordance with one embodiment. Here the method (50) can include measuring a first temperature of a paving material (52) in a hopper of the paving machine; measuring a second temperature of the screed plate (54); and a controller determining, from the first and second temperatures, an operating condition of the screed plate based on the first and second temperatures (56).

As discussed above, in an optional step (58) the controller can be configured to deliver a warning to an operator of the paving machine if the controller determines that the operating condition of the screed plate will result in paving material building up on the screed plate by sticking to or burning to the screed plate. For example, if the difference in temperatures between the paving material and the screed plate is out of a desired range.

Likewise, in optional step (58), the controller can be configured to automatically change the second temperature of the screed plate if the controller determines that the operating condition of the screed plate will result in material building up on the screed plate by sticking to or burning on the screed plate.

The method (50) can further include providing a mat quality sensor configured to determine a quality of the mat behind the screed plate.

In summary, by monitoring machine conditions before/during/after paving operations, buildup of excess material on a screed plate may be identified and an operator can be informed/instructed to inspect and clean the machine as necessary to restore performance. In another option, the controller of the machine can automatically make any changes, if possible. These conditions can be determined using temperature sensors to know the material temperature as delivered, screed plate temperature sensors to know the temperature of the contacting plate as well as other sensors. Additional information from other mat quality sensors (visual, tactile) can also be used as inputs to analyze the effectiveness of the screed plates; i.e. Are they clean and at an appropriate temperature? When decreased performance is identified, the operator and other monitoring systems can be notified and maintenance/cleaning can be performed.

Overall, the present system for monitoring machine conditions can include one or more of: temperature sensors that sense the temperature of the material delivered and the temperature of the screed plate; information from mat quality sensors such as visual or tactile etc. can be used to analyze effectiveness of the screed plates; and a comparison of expected thermal response of the screed with actual readings to identify material build-up. Then an operator can be notified for maintenance/cleaning if decreased performance is measured.

The above detailed description is intended to be illustrative, and not restrictive. The scope of the disclosure should, therefore, be determined with references to the appended claims, along with the full scope of equivalents to which such claims are entitled.

What is claimed is:

1. A paving machine comprising:

a frame including a hopper;

a screed coupled to the frame and including a screed plate;

a first temperature sensor configured to measure a first temperature of a paving material in the hopper;

a second temperature sensor to measure a second temperature of the screed plate; and a controller including a database of expected screed plate thermal responses to a given screed plate temperature setting, the controller configured to receive the first and second temperatures, determine an operating condition of the screed plate based on the first and second temperatures, and determine if the screed plate is taking too long to heat up.

2. The paving machine of claim 1, wherein the controller is configured to deliver a warning to an operator of the paving machine if the controller determines that the operating condition of the screed plate will result in the paving material building up on the screed plate.

3. The paving machine of claim 1, wherein the controller is configured to automatically change the second temperature of the screed plate if the controller determines that the operating condition of the screed plate will result in the paving material building up on the screed plate.

4. The paving machine of claim 1, further including a mat quality sensor configured to determine a quality of a mat behind the screed.

5. The paving machine of claim 4, wherein the mat quality sensor includes a visual sensor or a tactile sensor.

6. The paving machine of claim 5, wherein the controller receives mat quality information from the mat quality sensor and the controller is configured to determine an operating condition of the screed plate based at least in part on the mat quality information.

7. The paving machine of claim 6, wherein the controller is configured to automatically change the second temperature of the screed plate if the controller determines that the operating condition of the screed plate is that the paving material is building up on the screed plate.

8. The paving machine of claim 6, wherein the controller is configured to deliver an operator warning to raise the temperature of the screed plate if the controller determines the screed plate is too cold and the paving material is stuck to the screed plate or to clean the screed plate and reduce the temperature of the screed plate if the controller determines that the screed plate is too hot and the paving material is burned onto the screed plate.

9. A method of monitoring a condition of a screed plate of a paving machine, the method comprising:

measuring a first temperature of a paving material in a hopper of the paving machine;

measuring a second temperature of the screed plate; and a controller determining, from the first and second temperatures as well as from a database of expected screed plate thermal responses to a given screed plate temperature setting:

an operating condition of the screed plate based on the first and second temperatures, and whether the screed plate is taking too long to heat up.

10. The method of claim 9, wherein the controller is configured to deliver a warning to an operator of the paving machine if the controller determines that the operating condition of the screed plate will result in the paving material building up on the screed plate.

11. The method of claim 9, wherein the controller is configured to automatically change the second temperature of the screed plate if the controller determines that the operating condition of the screed plate will result in the paving material building up on the screed plate.

12. The method of claim 9, further including a mat quality sensor configured to determine a quality of the mat behind the screed.

13. The paving machine of claim 12, wherein the mat quality sensor includes a visual sensor and the controller is configured to form a virtual 3D map of a surface of the mat based on input from the visual sensor.

14. The paving machine of claim 12, wherein the controller is configured to automatically change a temperature of the screed plate if the controller determines that the operating condition of the screed plate is causing a physical flaw in the mat.

15. The paving machine of claim 12, wherein the controller is configured to deliver an operator warning to raise a temperature of the screed plate if the controller determines the screed plate is too cold or to reduce the temperature of the screed plate stop and clean the screed plate if the controller determines that the screed plate is too hot and a paving material is burned onto the screed plate.

* * * * *